US006971855B2

(12) United States Patent
Richards et al.

(10) Patent No.: US 6,971,855 B2
(45) Date of Patent: Dec. 6, 2005

(54) BLADE ARRANGEMENT FOR GAS TURBINE ENGINE

(75) Inventors: Martyn Richards, Burton on Trent (GB); Kenneth F Udall, Derby (GB); Andrew Swift, Denstone (GB)

(73) Assignee: Rolls-Royce plc, London (GB)

( * ) Notice: Subject to any disclaimer, the term of this patent is extended or adjusted under 35 U.S.C. 154(b) by 49 days.

(21) Appl. No.: 10/724,629

(22) Filed: Dec. 2, 2003

(65) Prior Publication Data

US 2004/0131471 A1 Jul. 8, 2004

(30) Foreign Application Priority Data

Dec. 20, 2002 (GB) ..... 0229680

(51) Int. Cl.[7] ..... F01D 5/32

(52) U.S. Cl. ..... 416/220 R; 416/244 R

(58) Field of Search ..... 416/219 R, 220 R, 416/204 A, 244 R

(56) References Cited

U.S. PATENT DOCUMENTS 3,734,646 A * 5/1973 Perkins ..... 416/220 R
4,207,029 A 6/1980 Ivanko

FOREIGN PATENT DOCUMENTS

EP 0 609 979 A 8/1994
GB 2 244 100 A 11/1991

* cited by examiner

*Primary Examiner*—Edward K. Look
*Assistant Examiner*—Richard A. Edgar
(74) *Attorney, Agent, or Firm*—W. Warren Taltavull; Manelli Denison & Selter PLLC

(57) ABSTRACT

A blade arrangement for a gas turbine engine includes a plurality of blades mounted for rotation on a disc so as to extend radially therefrom and a retention member, the retention member including an attachment portion which is attached to the disc and an abutment portion for resisting forward axial movement of at least one of the blades relative to the disc. The blade arrangement further comprises restraint means spaced from the attachment portion of the retention member, for substantially preventing radially outward movement of the abutment portion of the retention member when a forward axial force is applied by the blade to the abutment portion.

17 Claims, 6 Drawing Sheets

PRIOR ART

BLADE ARRANGEMENT FOR GAS TURBINE ENGINE

FIELD OF THE INVENTION

The invention relates to a blade arrangement for a gas turbine engine, particularly but not exclusively for a low pressure compressor or fan.

BACKGROUND OF THE INVENTION

A blade arrangement for a gas turbine engine fan includes a plurality of fan blades mounted for rotation on a fan disc so as to extend radially outwardly from the disc. Each blade is mounted on the disc via a root portion of the blade which fits into a complementary slot in the disc. The root portion may for example be "dovetail" shaped. The blade arrangement is conventionally contained within a fan case, a small clearance being provided between radially outer tips of the blades and the fan case.

If a single fan blade of the blade arrangement becomes detached from the disc, this produces a very large forward axial force on the adjacent blade. Large forward axial forces are also imposed on the other remaining blades because the loss of a single blade results in the distortion or ovality of the fan case. The more the casing distorts, the heavier the contact between the casing inner surface and the remaining blade tips, leading to increased forward force on each remaining blade as it rotates past the distortions in the casing. There is consequently a requirement to restrain the remaining blades in the axial direction, to prevent further blade loss.

Conventionally, axial restraint has been provided by a thrust ring. This consists of a generally annular member which is attached to the disc and which includes an abutment portion located axially forward of the blades. When an axially forward force is exerted on a blade, the blade abuts against the thrust ring and is retained in place on the disc.

As engines have increased in size, the magnitudes of the forces exerted on the blades in the event of a single blade being lost have increased. A larger, heavier blade can cause increased distortion of the fan case leading to increased forward forces on the remaining blades as they rotate past the distortions in the casing. There is thus a desire to provide an improved thrust ring.

SUMMARY OF THE INVENTION

According to the invention there is provided a blade arrangement for a gas turbine engine, the blade arrangement comprising:

a plurality of blades mounted for rotation on a disc so as to extend radially outwardly therefrom; and a retention member, the retention member including an attachment portion which is attached to the disc and an abutment portion for resisting forward axial movement of at least one of the blades relative to the disc;

the blade arrangement further comprising restraint means spaced from the attachment portion of the retention member, for substantially preventing radially outward movement of the abutment portion of the retention member when a forward axial force is applied by the blade to the abutment portion.

Where the term "forward" is used throughout this specification it refers to a direction towards the front of the engine in normal use.

The blade arrangement may form part of a low pressure compressor or fan.

Preferably the retention member is shaped such that the abutment portion contacts part of the blade when a forward axial force is applied to the blade, to resist forward axial movement of the blade.

Preferably the geometry of the blade arrangement is such that when the blade applies a forward axial force to the abutment portion of the retention member, a vector representing the resultant force applied to the retention member passes substantially through the attachment portion of the retention member.

Preferably the restraint means includes a part of the retention member which is shaped such that its radial movement is substantially prevented by an adjacent part of the blade or the disc. Where a part of the blade or disc is referred to this is intended to include any additional member attached to the blade or disc. The said part of the retention member may comprise a restraint member extending from a remainder of the retention member in an axially rearwards direction. Preferably the adjacent part of the blade or disc is located radially outwardly of the restraint member. A small radial gap may be provided between the restraint member and the adjacent part of the blade or disc. Preferably this gap is between up to 5 mm in width.

The attachment portion of the retention member is preferably located axially forwardly of the abutment portion and of the restraint means. The attachment portion is preferably attached to the disc by attachment means. The disc may also include an attachment portion, to which the retention member is attached. The attachment means preferably includes a bolt arrangement, the bolt extending in the axial direction, and passing through both respective attachment portions of the retention member and the disc.

Preferably the retention member includes an arm portion which extends between the attachment portion and the restraint member. Preferably the arm portion is angled at between 10° and 80° to the axial direction of the blade arrangement. The arm portion may be angled at between 20° and 50° to the axial direction.

Preferably the arm portion is substantially frustoconical in shape.

The restraint member may be substantially cylindrical in shape. Preferably the cylinder is generally co-axial with the disc. The adjacent part of the fan blade or disc may comprise a substantially cylindrical member provided on the blade, located radially outwardly of and adjacent to the restraint member, to substantially prevent radially outward movement of the restraint member.

Alternatively the restraint member may comprise an elongate finger, located between the disc and the blade. Preferably the finger extends rearwardly from a remainder of the retention member, in the axial direction. Preferably the retention member includes a plurality of elongate fingers each located between a blade and the disc. Preferably an elongate finger is located between each blade and the disc.

According to the invention there is further provided a gas turbine engine including a blade arrangement according to any of the preceding definitions. The blade arrangement may form part of a low pressure compressor or fan of the gas turbine engine.

BRIEF DESCRIPTION OF THE DRAWINGS

Embodiments of the invention will be described for the purpose of illustration only, with reference to the accompanying drawings, in which.

DETAILED DESCRIPTION OF THE INVENTION

Figure 1:
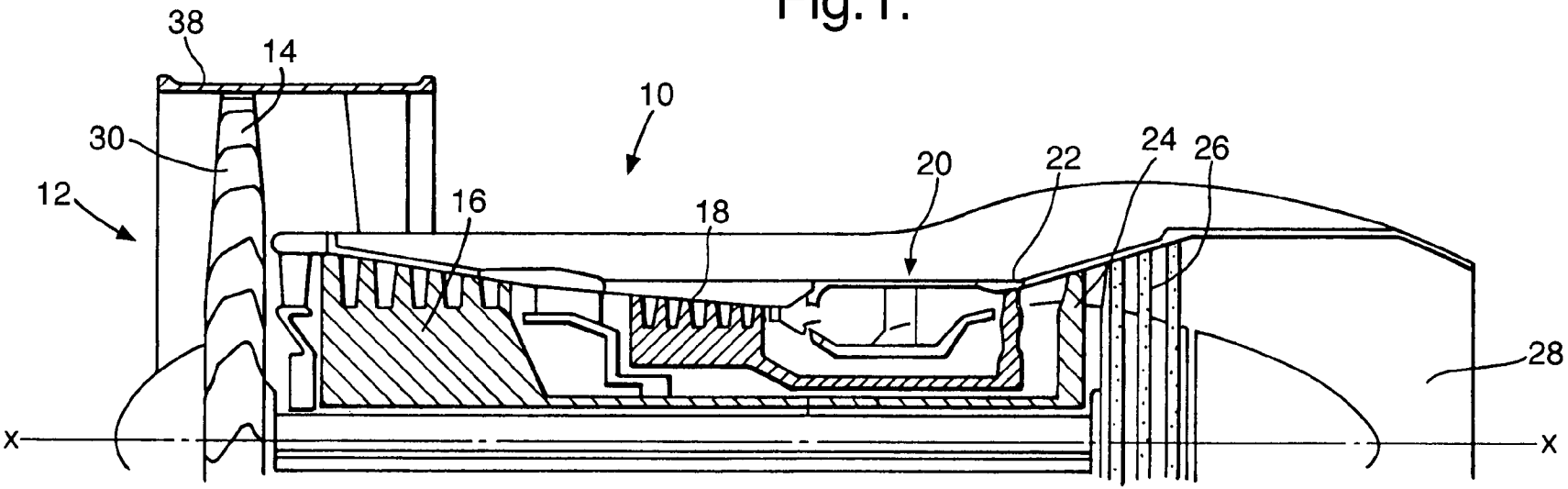
Fig.1. PRIOR ART
FIG. 1 is a diagrammatic sectional view showing the general arrangement of a known gas turbine engine.

With reference to FIG. 1 a ducted fan gas turbine engine generally indicated at 10 comprises, in axial flow series, an air intake 12, a propulsive fan 14, an intermediate pressure compressor 16, a high pressure compressor 18, combustion equipment 20, a high pressure turbine 22, an intermediate pressure turbine 24, a low pressure turbine 26 and an exhaust nozzle 28.

The gas turbine engine 10 works in the conventional manner so that air entering the intake 12 is accelerated by the fan 14 to produce two air flows, a first air flow into the intermediate pressure compressor 16 and a second airflow of "bypass air" which provides propulsive thrust. The intermediate pressure compressor 16 compresses the air flow directed into it before delivering the air to the high pressure compressor 18 where further compression takes place.

The compressed air exhausted from the high pressure compressor 18 is directed into the combustion equipment 20 where it is mixed with fuel and the mixture combusted. The resultant hot combustion products then expand through and thereby drive the high, intermediate and low pressure turbines 22, 24 and 26 before being exhausted through the nozzle 28 to provide additional propulsive thrust. The high, intermediate and low pressure turbines 22, 24 and 26 respectively drive the high and intermediate pressure compressors 16 and 18 and the fan 14 by suitable interconnecting shafts.

Figure 2:
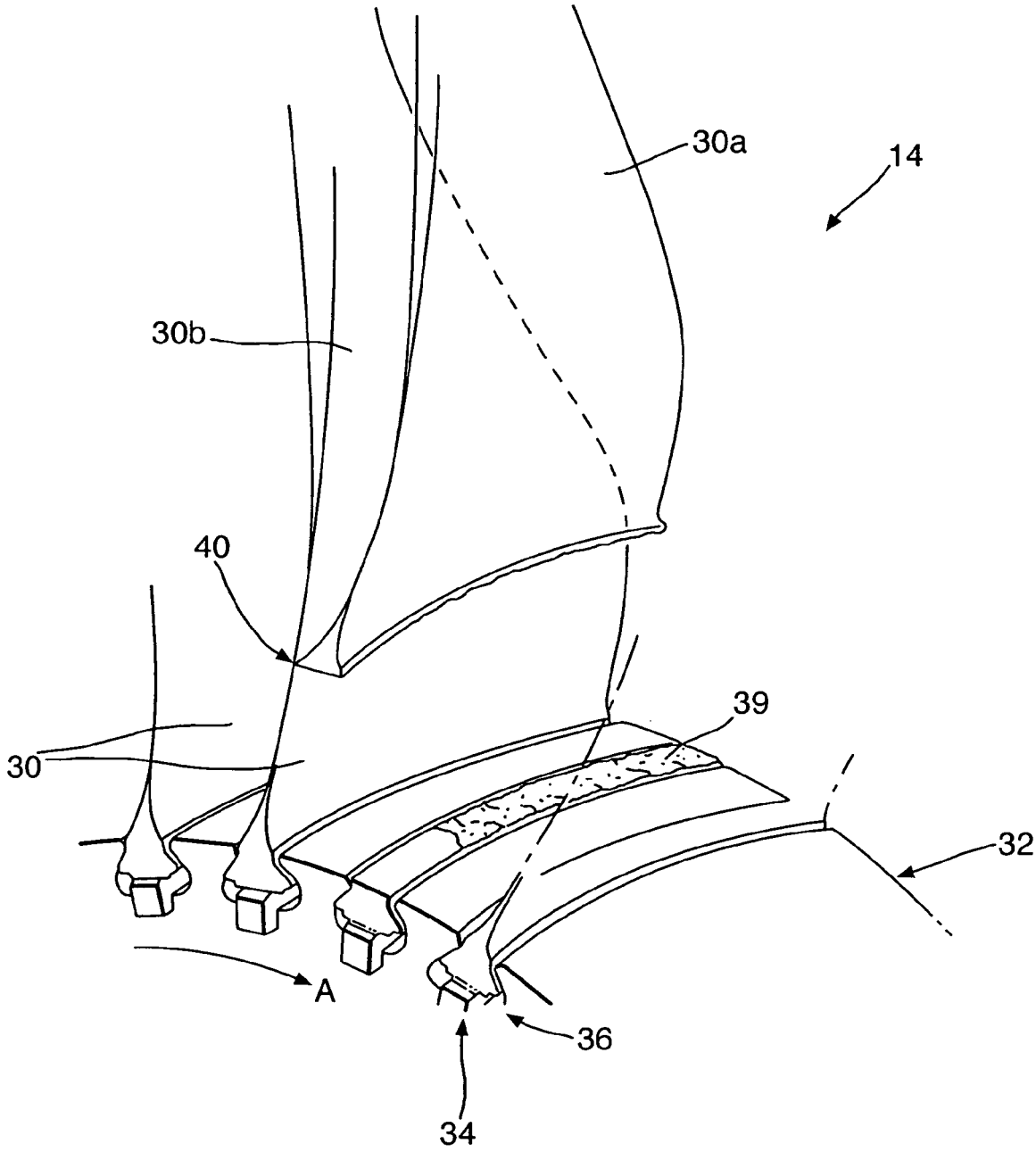
FIG. 2 is a diagrammatic perspective view of part of a known blade arrangement for a gas turbine engine fan, showing a lost blade.

FIG. 2 illustrates in more detail a part of a blade arrangement in the form of a fan 14 for the gas turbine engine 10. The fan 14 includes a plurality of fan blades 30 extending radially outwardly from a disc 32. Each blade 30 includes a dovetail root portion 34 fitting into a complementary slot 36 in the disc 32. A fan case 38 (see FIG. 1) surrounds the blades 30, a small clearance being provided between radially outer tips of the blades 30 and the fan case 38.

Referring again to FIG. 2, a single fan blade 30*a* has been lost from the disc 32, along a release plane 39. The released blade 30*a* initially impacts an adjacent trailing blade 30*b* at an impact point 40, exerting a substantial forward axial force on that blade. A forward axial force is also exerted on the remaining blades by the distortion of the fan case 38, as explained previously.

Figure 3:
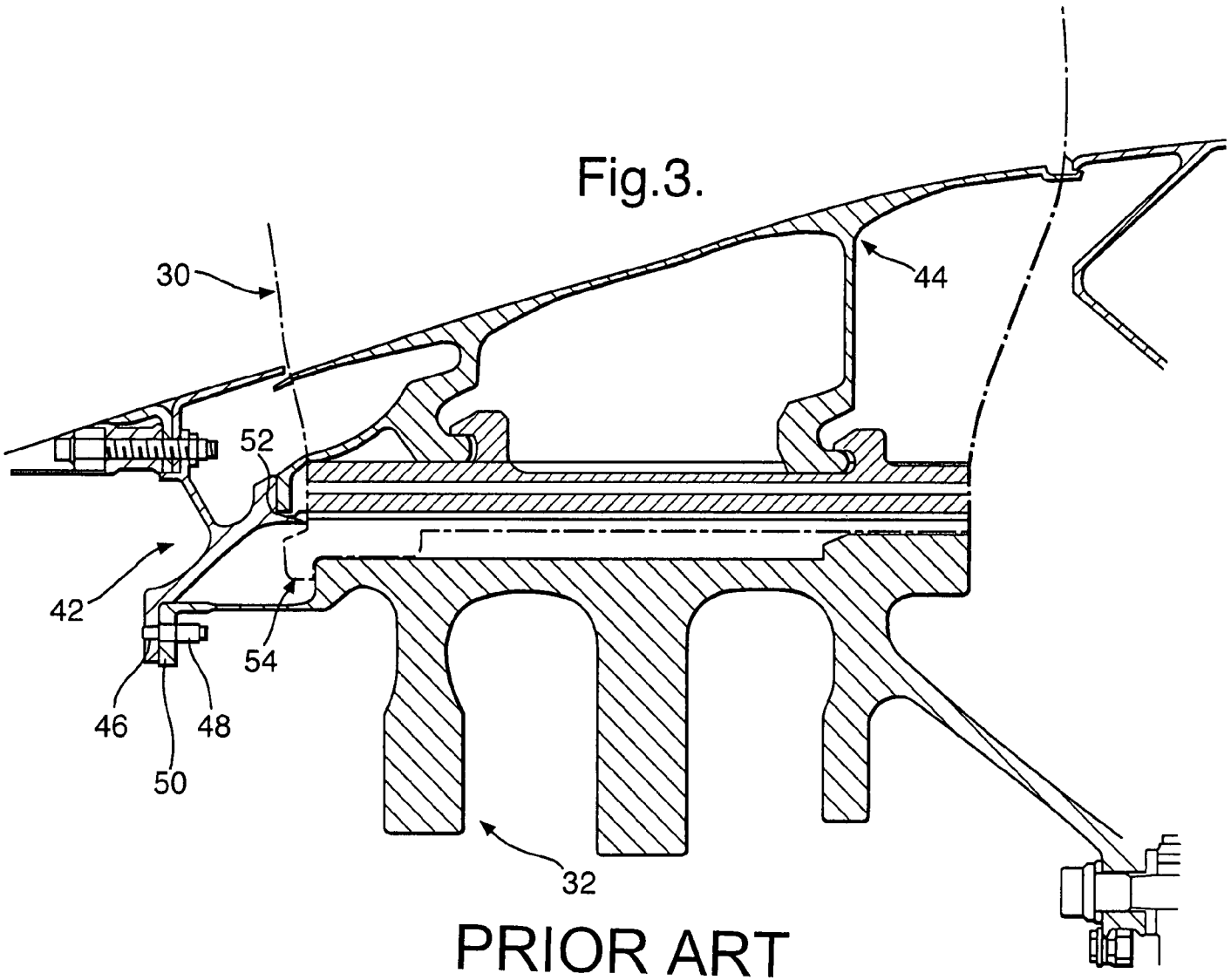
Fig.3. PRIOR ART
FIG. 3 is a diagrammatic sectional view of part of a blade arrangement incorporating a known thrust ring.

Referring to FIG. 3, it is known to use a thrust ring 42 to provide axial restraint for the blades 30, when a single blade is released. FIG. 3 shows a blade 30 mounted on a disc 32, an annulus filler 44 also being visible. The annulus filler 44 fits between adjacent blades and provides a smooth surface for airflow between the blades.

The thrust ring 42 is generally annular in overall shape and includes a ring shaped attachment portion 46, which is attached by means of axially extending bolts 48 to an adjacent ring shaped attachment portion 50 of the disc 32.

The thrust ring further includes an abutment portion 52 which is located axially forwardly of a stop lug 54 attached to the blade root portion 34. The abutment portion 52 thereby restrains axially forward movement of the blade 30.

Figure 4:
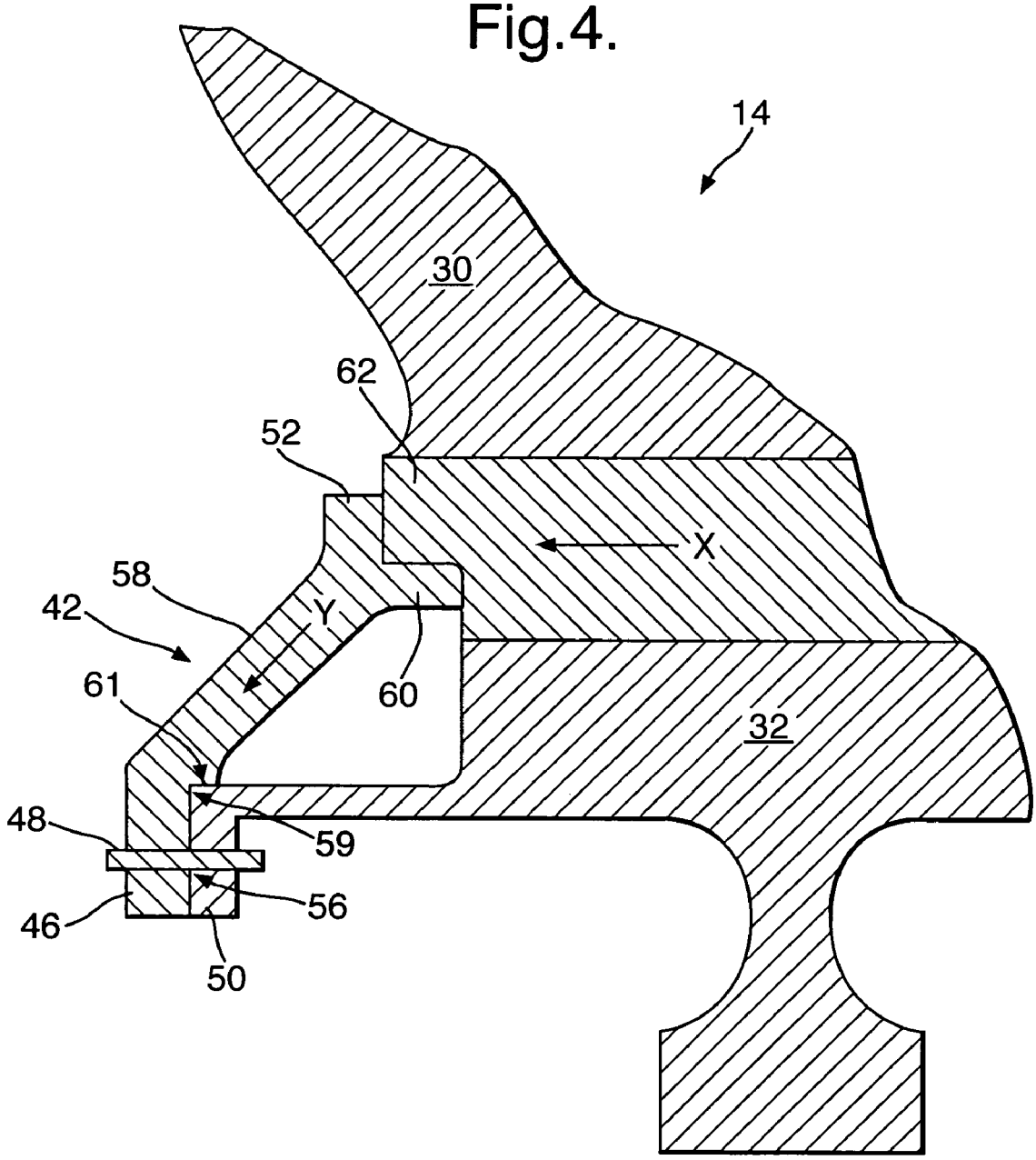
FIG. 4 is a diagrammatic sectional view of part of a blade arrangement according to a first embodiment of the invention.

Referring to FIG. 4, there is illustrated in section a part of an improved blade arrangement in the form of a fan 14.

The fan 14 includes a plurality of fan blades 30 (only one of which is visible in FIG. 4) mounted on a disc 32, as previously described. The fan arrangement further includes a retention member in the form of a thrust ring 42.

The thrust ring 42 is generally annular, being shown in section in FIG. 4, and includes an attachment portion 46 which is generally ring shaped. The attachment portion 46 forms a radially inner part of the thrust ring 42, and is located at its axially forward end. The attachment portion 46 is affixed to a generally ring shaped attachment portion 50 of the disc 32, by attachment means in the form of bolts 48, just one of which is visible and indicated schematically in FIG. 4. The bolts 48 extend axially through the attachment portions 46 and 50 and hold the thrust ring 42 to the disc 32, preventing relative axial movement therebetween. An attachment point 56 is defined where the bolts 48 intersect the plane where the attachment portions 46 and 50 meet.

The thrust ring 42 further includes an arm portion 46 and which is generally frustoconical in shape (and therefore straight and sloping in section as illustrated in FIG. 4). The arm portion 58 in this embodiment slopes at an angle of about 55° to the axial direction.

At its axially forward and radially inner end, the arm portion 58 includes an undercut shoulder 59, which is generally L-shaped in section, and of complementary shape to a right angled radially outer corner 61 of the attachment portion 50.

At an axially rearward and radially outward end of the arm portion 58, the thrust ring 42 includes restraint means in the form of a restraint member 60. The restraint member 60 is generally cylindrical in shape, extending backwards from the arm portion 58 in the axial direction.

The thrust ring 42 further includes an abutment portion 52 which extends radially outwardly from the arm portion 58. The abutment portion 52 is generally ring shaped, and is located rearwardly of the attachment portion 46, and hence of the attachment point 56.

The blade 30 is formed with a post member 62 which in normal operation touches or nearly touches the restraint member 60 and the abutment portion 52 of the thrust ring 42. The post member 62 extends in the axially forward direction from the remainder of the blade 30 and lies radially outwardly of the abutment portion 52 of the thrust ring 42. Although just one post member 62 is illustrated in FIG. 4, each fan blade 30 would include a post member.

The thrust ring 42 functions as follows. If a blade is lost from the disc 32 a large rearward force is exerted on the remainder of the blades, including the blade 30 illustrated in FIG. 4. The initial force is in the direction of the arrow X. This force causes the post member 62 to abut against the abutment portion 52 of the thrust ring 42. Because the thrust ring 42 is affixed to the disc 32 via the bolts 48, at the point of attachment 56, the axially directed force causes a bending moment about the bolts 48. The applicant has appreciated that in prior art designs of thrust ring this force results in a rolling moment which causes a slight radially outward movement of the abutment portion 52 of the thrust ring. This causes the generally frustoconical shape of the thrust ring 42 to open out slightly causing bending about the bolts 48 and possible weakening of the bolts 48.

In the thrust ring 42 of FIG. 4, any radially outward movement of the abutment portion 52 is prevented by the engagement of the restraint member 60 against the post member 62 on the blade 30. Because the point of attachment 56 and the bolts 48 are located forwardly of the abutment portion 52, the angle of the arm portion 58 relative to the axial direction cannot increase without the restraint member 60 moving radially outwardly, this being prevented by the post member 62.

The geometry of the restraint member 60, abutment portion 52 and the post member 62 on the blade 30 is such that when the blade 30 exerts an axially forward force on the restraint member 60 and the abutment portion 52, a vector representing the resultant force applied to the thrust ring extends in the direction of the arrow Y, i.e. down the arm portion 58 of the thrust ring 42, via the shoulder 59 generally through the bolts 48, and preferably substantially through the point of attachment 56. There is therefore substantially no bending moment about the point of attachment 56. The bolts 48 are strong under direct non-bending forces and the performance of the bolts 48 is therefore improved. The above effect is caused by the triangulation of the thrust ring geometry which, under forward thrust loading, produces a resultant force vector extending generally through the point of attachment 56.

Figure 5:
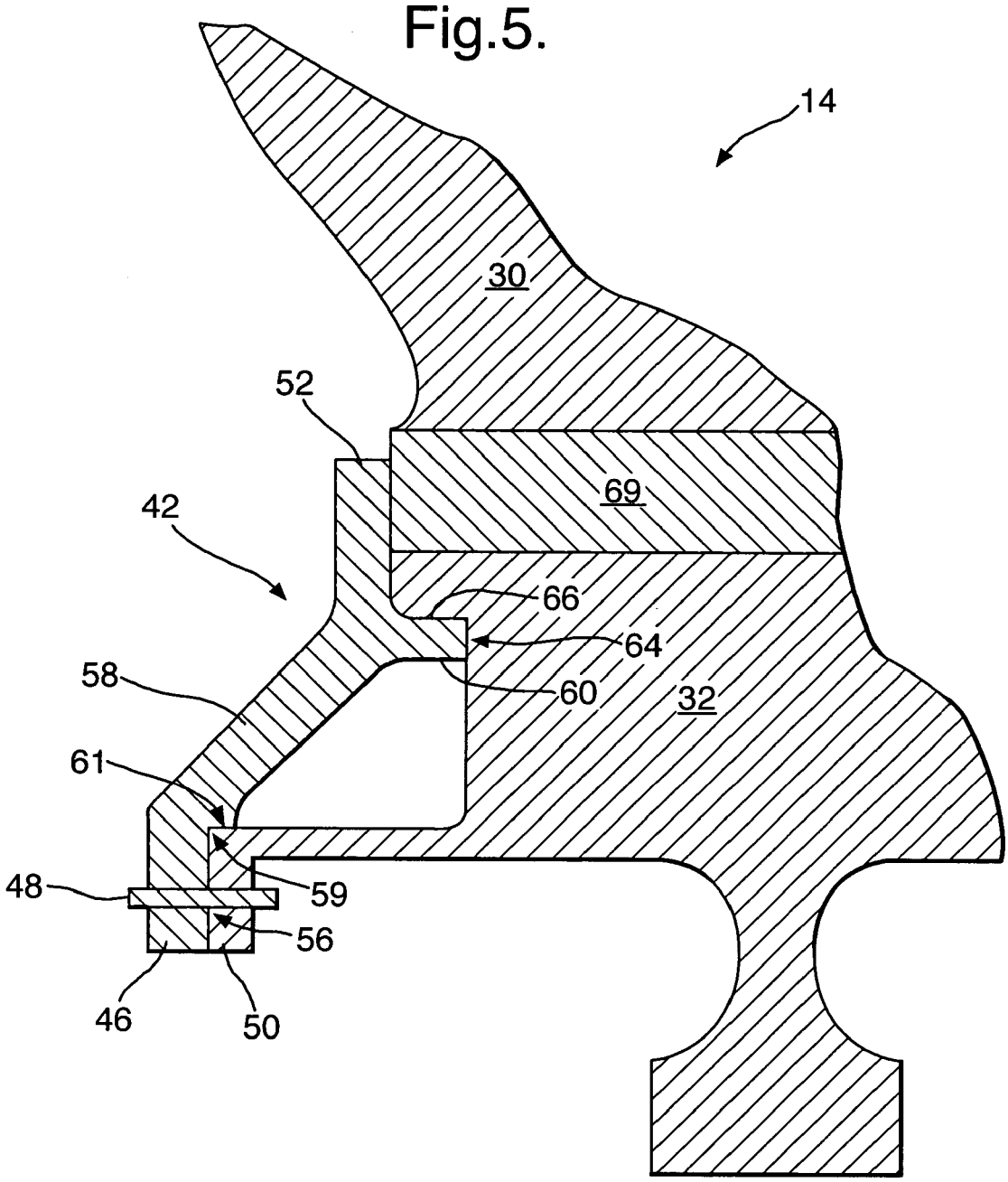
FIG. 5 is a diagrammatic sectional view of part of a blade arrangement according to a second embodiment of the invention.

Referring to FIG. 5, there is illustrated an alternative embodiment of the invention, in which corresponding parts are indicated with the same reference numerals as in FIG. 4. The thrust ring 42 of the FIG. 5 embodiment is of generally similar shape to that of the FIG. 4 embodiment, including an attachment portion 46 which is affixed via bolts 48 to an attachment portion 50 of the disc 32. The thrust ring 42 further includes a sloping arm portion 58 (having an undercut L-shaped shoulder portion 59) and a restraint member 60, as in the previous embodiment. In the FIG. 5 embodiment however, the arm portion 58 is shorter and the restraint member 60 locates in an undercut portion 64 of the disc 32. The undercut portion 64 defines a shoulder 66 of the disc, the shoulder 66 being generally annular and adjacent to and radially outwards of the restraint member 60.

The thrust ring 42 further includes an abutment portion 52 which is generally ring shaped and which extends radially outwardly from a remainder of the thrust ring 42. As in the previous embodiment, the abutment portion 52 is located axially forwardly of a part of the blade 30 and resists forward axial movement of the blade.

The embodiment of FIG. 5 works in a similar way to that described with reference to the FIG. 4 embodiment, except that the restraint member 60 is prevented from radially outward movement by the shoulder 66 of the disc 32 rather than by the post member 62 of the blade 30.

Figure 6:
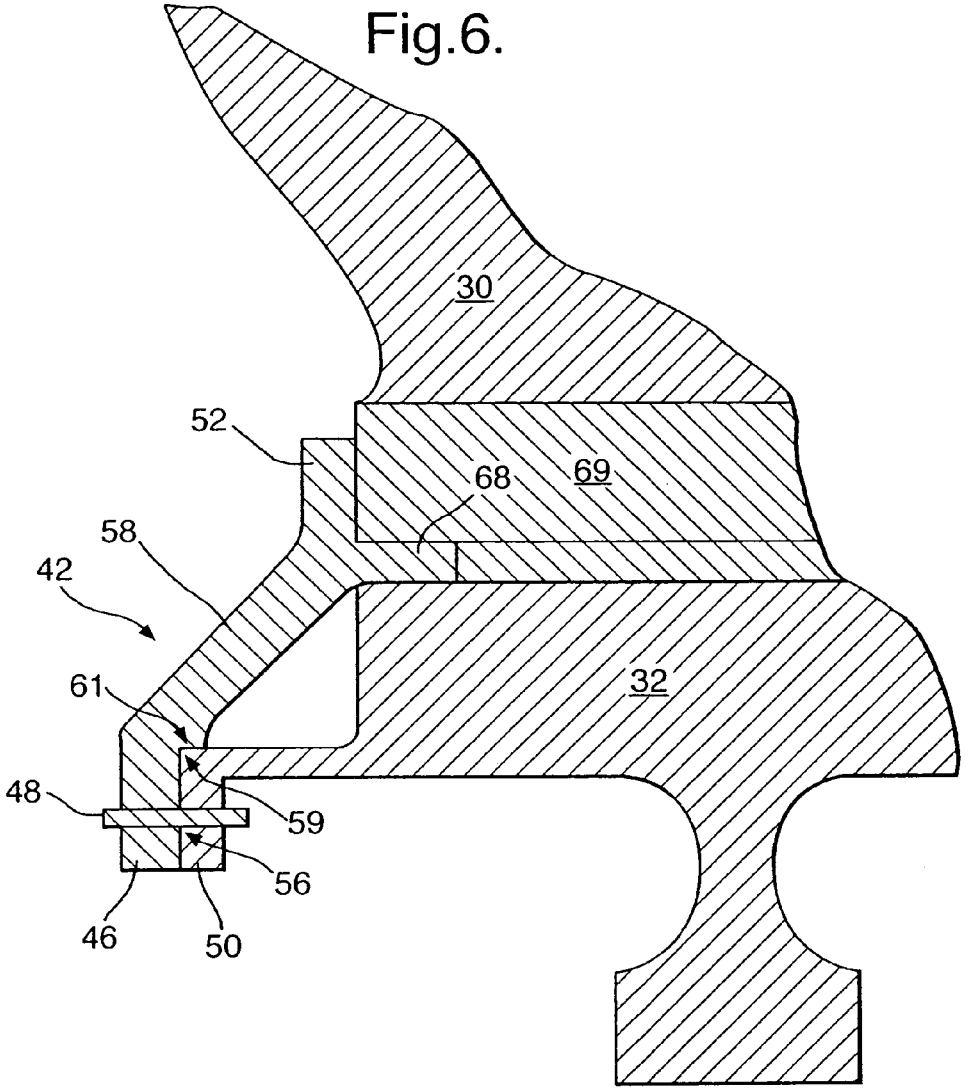
FIG. 6 is a diagrammatic sectional view of part of a blade arrangement according to a third embodiment of the invention.

Referring to FIG. 6, there is illustrated an alternative embodiment of the invention, in which corresponding reference numerals are again used. The thrust ring 42 of FIG. 6 is generally similar to that of FIG. 4 except that the restraint member 60 is replaced by a plurality of restraint means in the form of restraint fingers 68. The fingers 68 are elongate and extend axially backwards from the remainder of the thrust ring 42. A restraint finger 68 is located between the disc 32 and a restraining base part 69 of each individual fan blade 30 and functions in a similar manner to the restraint member 60 of the previous embodiments.

Figure 7:
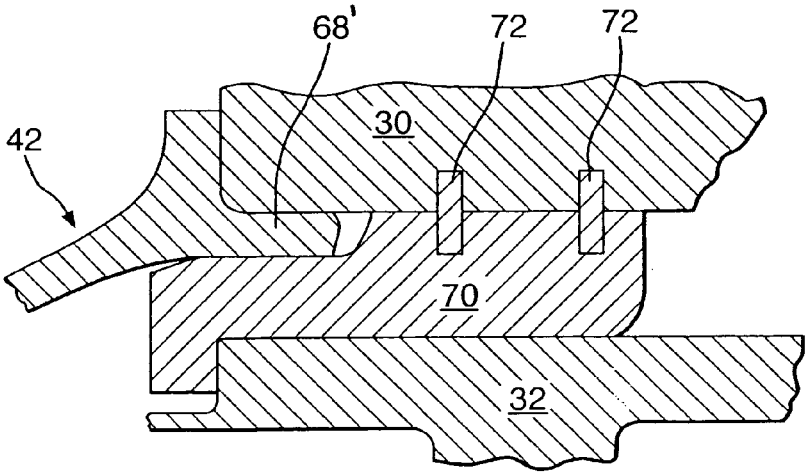
FIG. 7 is a diagrammatic sectional view of part of a blade arrangement according to a fourth embodiment of the invention.

FIG. 7 (which shows just part of the retention member 42) illustrates a variation of the FIG. 6 embodiment. The restraint fingers 68' are smaller than restraint fingers 68 and fit between a chuck 70 and the blade 30. Dowels 72 are provided to prevent relative axial movement of the blade 30 and the chuck 70.

There are thus provided various embodiments of a blade arrangement wherein axial forces on the thrust ring 42 are resolved into forces which are directed generally through the point of attachment 56 of the thrust ring 42 to the disc 32. This triangulation of the thrust ring geometry produces direct loads on the attachment bolts 48 and avoids rolling moments which tends to overload the bolts.

Various modifications may be made to the above described embodiment without departing from the scope of the invention. For example, a small clearance may be provided between the restraint member 60 of the thrust ring 42 and the part of the blade 30 or disc 32 against which it abuts, this allowing some deflection to absorb shock loading. The precise geometry may be varied and the section lengths, thicknesses and angles may be optimised by use of computer optimisation techniques. In the described embodiments the restraint member/restraint fingers abut against a part of the blade 30 or disc 32. They could of course abut against a further part attached to the blade or disc.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A blade arrangement for a gas turbine engine, the blade arrangement comprising:

a plurality of blades mounted for rotation on a disc so as to extend radially outwardly therefrom; and a retention member, the retention member including an attachment portion which is attached to the disc and an abutment portion for resisting forward axial movement of at least one of the blades relative to the disc;

wherein the blade arrangement further comprises restraint means spaced from the attachment portion of the retention member, for substantially preventing radially outward movement of the abutment portion of the retention member when a forward axial force is applied by the blade to the abutment portion wherein the attachment portion of the retention member is located axially forwardly of the abutment portion and of the restraint means.

2. A blade arrangement according to claim 1 wherein the retention member includes an arm portion which extends between the attached portion and the restraint means, the arm portion being angled at between 40° and 70° to the axial direction of the blade arrangement.

3. A blade arrangement according to claim 1 wherein the retention member is shaped such that the abutment portion contacts part of the blade when a forward axial force is applied to the blade, to resist forward axial movement of the blade.

4. A blade arrangement according to claim 3 wherein the geometry of the blade arrangement is such that when the blade applies a forward axial force to the abutment portion of the retention member, a vector representing the resultant force applied to the retention member passes substantially through the attachment portion of the retention member.

5. A blade arrangement according to claim 4 wherein the restraint means includes a part of the retention member which is shaped such that its radial movement is substantially prevented by an adjacent part of the blade or the disc.

6. A blade arrangement according to claim 1 wherein the restraint means is substantially cylindrical in shape, and the adjacent part of the fan blade or disc comprises a substantially cylindrical member, located radially outwardly of and adjacent to the restraint means, to substantially prevent radially outward movement of the restraint means.

7. A blade arrangement according to claim 1, wherein the blade arrangement forms part of a low pressure compressor or fan.

8. A gas turbine engine including a low pressure compressor or fan including a blade arrangement according to claim 1.

9. A blade arrangement for a gas turbine engine, the blade arrangement comprising:

a plurality of blades mounted for rotation on a disc so as to extend radially outwardly therefrom; and a retention member, the retention member including an attachment portion which is attached to the disc and an abutment portion for resisting forward axial movement of at least one of the blades relative to the disc;

where in the blade arrangement further comprises restraint means spaced from the attachment portion of the retention member, for substantially preventing radially outward movement of the abutment portion of the retention member when a forward axial force is applied by the blade to the abutment portion wherein the retention member is shaped such that the abutment portion contacts part of the blade when a forward axial force is applied to the blade, to resist forward axial movement of the blade wherein the geometry of the blade arrangement is such that when the blade applies a forward axial force to the abutment portion of the retention member, a vector representing the resultant force applied to the retention member passes substantially through the attachment portion of the retention member wherein the restraint means includes a part of the retention member which is shared such that its radial movement is substantially prevented by an adjacent part of the blade or the disc wherein the said part of the retention member comprises a restraint member extending from a remainder of the retention member in an axially rearwards direction, the adjacent part of the blade or disc being located radially outwardly of the restraint member.

10. A blade arrangement according to claim 9 wherein the abutment portion and the restraint member together comprise a portion of the restraint member which is generally L-shaped in section.

11. A blade arrangement according to claim 9 wherein the attachment portion of the retention member is located axially forwardly of the abutment portion and of the restraint means.

12. A blade arrangement according to claim 11 wherein the disc also includes an attachment portion, to which the retention member is attached, via a bolt arrangement, the bolt extending in the axial direction, and passing through both respective attachment portions of the retention member and the disc.

13. A blade arrangement according to claim 12 wherein the restraint means includes an arm portion which extends between the attachment portion and the restraint member, the arm portion being angled at between 40° and 70° to the axial direction of the blade arrangement.

14. A blade arrangement according to claim 13 wherein the arm portion includes an undercut shoulder, which is generally L-shaped in section, and of complementary shaped to a radially outer corner of the attachment portion.

15. A blade arrangement according to claim 13 wherein the arm portion is substantially frustoconical in shape.

16. A blade arrangement for a gas turbine engine, the blade arrangement comprising:

a plurality of blades mounted for rotation on a disc so as to extend radially outwardly therefrom; and a retention member, the retention member including an attachment portion which is attached to the disc and an abutment portion for resisting forward axial movement of at least one of the blades relative to the disc;

where in the blade arrangement further comprises restraint means spaced from the attachment portion of the retention member, for substantially preventing radially outward movement of the abutment portion of the retention member when a forward axial force is applied by the blade to the abutment portion wherein the restraint means comprises an elongate finger, located between the disc and the blade, the finger extending rearwardly from a remainder of the retention member, in the axial direction.

17. A blade arrangement according to claim 16 wherein the retention member includes a plurality of elongate fingers each located between a blade and the disc, an elongate finger being located between each blade and the disc.

* * * * *